US010235871B2

(12) United States Patent
Wang et al.

(10) Patent No.: US 10,235,871 B2
(45) Date of Patent: Mar. 19, 2019

(54) INFORMATION TRANSMISSION METHOD, APPARATUS AND COMPUTER STORAGE MEDIUM

(71) Applicant: Ninebot (Beijing) Tech. Co., Ltd, Beijing (CN)

(72) Inventors: Xuhui Wang, Beijing (CN); Guanjiao Ren, Beijing (CN)

(73) Assignee: NINEBOT (BEIJING) TECH. CO., LTD, Beijing (CN)

( * ) Notice: Subject to any disclaimer, the term of this patent is extended or adjusted under 35 U.S.C. 154(b) by 0 days.

(21) Appl. No.: 15/522,104

(22) PCT Filed: Oct. 17, 2016

(86) PCT No.: PCT/CN2016/102272

§ 371 (c)(1),
(2) Date: Apr. 26, 2017

(87) PCT Pub. No.: WO2018/018760

PCT Pub. Date: Feb. 1, 2018

(65) Prior Publication Data

US 2018/0165947 A1 Jun. 14, 2018

(30) Foreign Application Priority Data

Jul. 29, 2016 (CN) ..... 2016 1 0618126

(51) Int. Cl.
*G08C 19/16* (2006.01)
*G08C 17/02* (2006.01)

(52) U.S. Cl.
CPC ..... *G08C 17/02* (2013.01); *G08C 2201/21* (2013.01); *G08C 2201/42* (2013.01); *G08C 2201/91* (2013.01)

(58) Field of Classification Search
CPC ..... G08C 17/02; G08C 2201/21; G08C 2201/42; G08C 2201/91
(Continued)

(56) References Cited

U.S. PATENT DOCUMENTS 6,094,156 A * 7/2000 Henty ..... G06F 3/021 340/12.55
9,402,245 B2 * 7/2016 Chen ..... H04W 4/70
(Continued)

FOREIGN PATENT DOCUMENTS

CN 103325234 A 9/2013
CN 104954103 A 9/2015
(Continued)

*Primary Examiner* — Kerri L McNally
*Assistant Examiner* — Thang D Tran
(74) *Attorney, Agent, or Firm* — Cooper Legal Group, LLC

(57) ABSTRACT

The embodiments of the present invention relate to the field of communications and discloses an information transmission method, apparatus and computer storage medium; wherein, the method comprising: when a second device acquires a first data which will be provided to a second device, determining whether the first device is in a positioning state with the second device; when the first device is in the positioning state with the second device, generating a first merged data by merging the first data with a first positioning signal used for positioning, wherein the first positioning signal is the positioning signal to be transmitted by the first device to the second device; and transmitting the first merged data to the second device.

20 Claims, 4 Drawing Sheets

(58) Field of Classification Search
USPC ..... 340/12.5
See application file for complete search history.

(56) References Cited

U.S. PATENT DOCUMENTS 10,117,210 B2 * 10/2018 Mori ..... H04W 4/70
2007/0045424 A1 * 3/2007 Wang ..... H04W 40/246 235/462.46
2010/0052939 A1 * 3/2010 Liang ..... G08C 17/02 340/12.22
2011/0285513 A1 * 11/2011 Shirai ..... G08C 17/02 340/12.5
2012/0001738 A1 * 1/2012 Hilgers ..... G08C 17/02 340/12.5
2012/0086631 A1 * 4/2012 Osman ..... A63F 13/655 345/156
2012/0169482 A1 * 7/2012 Chen ..... G08C 17/02 340/12.52
2012/0262374 A1 * 10/2012 Lai ..... G08C 17/02 345/158
2013/0005250 A1 * 1/2013 Kim ..... H04N 21/4126 455/41.1
2013/0022009 A1 * 1/2013 Yang ..... H04L 1/0031 370/329
2013/0095756 A1 * 4/2013 Hamilton ..... H04W 4/023 455/41.1
2013/0210452 A1 * 8/2013 Sung ..... H04W 24/00 455/456.1
2015/0058740 A1 * 2/2015 Asahi ..... G08C 17/02 715/740
2015/0135083 A1 * 5/2015 Hsu ..... H04W 64/00 715/736
2015/0278830 A1 * 10/2015 Zamer ..... G06Q 30/0201 705/7.29
2015/0280843 A1 * 10/2015 Fucci ..... H04B 17/27 455/41.2
2015/0309154 A1 * 10/2015 Lohbihler ..... B25J 13/089 702/158
2015/0319731 A1 * 11/2015 Cui ..... G01S 5/10 455/456.1
2016/0049017 A1 * 2/2016 Busse ..... G07C 5/008 701/33.3
2016/0274634 A1 * 9/2016 Shi ..... G06F 1/3287
2016/0278146 A1 * 9/2016 Dong ..... H04W 76/023
2016/0351047 A1 * 12/2016 Han ..... G06F 13/14
2017/0142682 A1 * 5/2017 Gunnarsson ..... G01S 5/0289
2017/0272900 A1 * 9/2017 Do ..... H04W 4/02

FOREIGN PATENT DOCUMENTS

CN 105338495 * 2/2016 ..... H04W 4/023
CN 105338495 A 2/2016
CN 106297233 A 1/2017
EP 1018457 A1 7/2000

* cited by examiner

INFORMATION TRANSMISSION METHOD, APPARATUS AND COMPUTER STORAGE MEDIUM

TECHNICAL FIELD

The present invention relates to the field of communications, and more particularly to an information transmission method, apparatus and computer storage medium.

TECHNICAL BACKGROUND

Along with the continuous development of science and technology, electronics technology has also rapidly developed as a result. With more and more different types of electronic products, people have benefited from the many conveniences brought about by the development of technology. Currently, people can use many different types of electronic devices, benefiting from the development of technology, for a more comfortable life. For example, electronic devices such as laptop computers, desktop computers, smart phones, and tablet PCs etc. have become an important part of people's lives. Users can use electronic devices such as mobile phones, and tablet PCs etc., to listen to music, and play games, etc., to reduce pressures from the active pace of modern life.

In the prior art, electronic devices may be controlled by a remote control. Current remote controls use Bluetooth, WiFi (Wireless-Fidelity), 433 MHz (MegaHertz), 315 MHz band, and Zigbee protocol (Zigbee) etc. wireless technology, infrared technology and ultrasonic technology. In implementing the above technical solutions, the inventors have found that at least the following problems exist in the prior art.

During actual implementation, some electronic devices require remote control and tracking and positioning functions, and in these electronic devices, remote control and tracking and positioning functions are individually designed and implemented, which makes the system design complex and affects system operating efficiency. When Ultra-Wideband (UWB) technology is used to implement the tracking and positioning functions, UWB beacons need to be tracked, wherein remote controls also need to be carried by users, which requires that users carry multiple devices, which is very inconvenient, and, logic for interaction between multiple devices is also more complex, and not simple enough.

SUMMARY OF INVENTION

In efforts to solve the above technical problems, the embodiments of the present invention hopes to disclose an information transmission method, apparatus and computer storage medium, solving the current technical problem for complex system designs of electronic devices having remote control and tracking and positioning functions.

In a first aspect, an embodiment of the present invention provides an information transmission method that is used in a first device, comprising:

when a first data is acquired which will be provided to a second device, determining whether the first device is in a positioning state with the second device;

when the first device is in a positioning state with the second device, generating a first merged data by merging the first data with a first positioning signal used for positioning, wherein the first positioning signal is the positioning signal to be transmitted by the first device to the second device; and transmitting the first merged data to the second device.

In the above proposal, optionally, generating the first merged data by merging the first data with a first positioning signal used for positioning, comprising:

writing the first data to a preset location of the first positioning signal to generate the first merged data, wherein the first merged data at least comprises the first data and a first positioning data.

In the above proposal, optionally, when the first device is in a positioning state with the second device, the method further comprising:

determining whether the first device can communicate with the second device by using the first positioning module; wherein generating the first merged data by merging the first data with a first positioning signal used for positioning, comprising:

if the first device can communicate with the second device by using the first positioning module, the first data is merged with the first positioning signal to generate the first merged data.

In the above proposal, optionally, the method further comprising:

if the first device cannot communicate with the second device by using the first positioning module, an another communications module of the first device which may be used to transmit the first data is used to transmit the first data to the second device via the communications module, wherein the another communications module which may be used to transmit the first data and the first positioning module have different functions.

In the above proposal, optionally, the method further comprising:

generating a control command for controlling the second device, wherein the control command is the first data;

determining whether there is a need to acquire a positioning result of the first device and the second device when the second device is implementing the control command; and when it is determined that the positioning result must be acquired, controlling the first device to enter into the positioning state with the second device.

In the above proposal, optionally, when the first device and the second device are in the positioning state, the method further comprising:

controlling the another communications module other than the first positioning module, which may be used to transmit the first data, to be in a closed state, wherein the first positioning module is used to determine the positioning of the first device and the second device, and wherein the another communications module which may be used to transmit the first data and the first positioning module have different functions.

In the above proposal, optionally, the method further comprising:

upon receiving a second positioning signal transmitted from the second device, determining whether the second positioning signal comprises the second data; and if the second positioning signal comprises the second data, parsing out the second data from the second positioning signal and controlling the second device according to the second data.

In a second aspect, an embodiment of the present invention provides an information transmission method that is used in a second device, comprising:

receiving a first positioning signal transmitted by a first device;

determining whether the first positioning signal comprises a first data;

if the first positioning signal comprises the first data, parsing out the first data and the first positioning data from the first positioning signal, and controlling the second device according to the first data and implementing positioning of the first device according to the first positioning data; and if the first positioning signal does not comprise the first data, parsing out the first positioning data from the first positioning signal, and implementing positioning of the first device according to the first positioning data.

In the above proposal, optionally, determining whether the first positioning signal comprises the first data, comprising:

extracting data of a preset location of the first positioning signal;

determining whether data of the preset location conforms to a preset rule;

if the preset location does not conform to a preset rule, determining that the first positioning signal comprises the first data, wherein the data of the preset location is the first data.

In the above proposal, optionally, the method further comprising:

when receiving the second data which is to be provided to the first device, generating a second merged data by merging the second data with a second positioning signal used for positioning; wherein the second positioning signal is the positioning signal to be transmitted by the second device to the first device; and transmitting the second merged data to the first device.

In the above proposal, optionally, generating a second merged data by merging the second data with a second positioning signal used for positioning, comprising:

writing the second data to a preset location of the second positioning signal to generate the second merged data, wherein the second merged data at least comprises the second data and the second positioning data.

In the above proposal, optionally, the method further comprising:

if the first positioning signal comprises the first data, controlling an another communications module other than the second positioning module of the second device which may be used to transmit the first data, to be in a closed state, wherein the another communications module which may be used to transmit the first data and the second positioning module have different functions.

From a third-party manufacturing aspect, an embodiment of the present invention provides a first apparatus, comprising:

a first determining module, configured to determine whether the first device is in a positioning state with a second device when acquiring a first data which will be provided to the second device;

a first merging module, configured to generate a first merged data by merging the first data with a first positioning signal used for positioning when the first device is in a positioning state with the second device, wherein the first positioning signal is transmitted by the first device to the second device; and a first transmitting module, configured to transmit the first merged data to the second device.

In the above proposal, optionally, the first merging module is configured to:

write the first data to a preset location of the first positioning signal to generate the first merged data, wherein the first merged data comprises at least the first data and a first positioning data.

In the above proposal, optionally, the first device further comprises:

a second determining module, configured to determine whether the first device can communication with the second device by using the first positioning module when the first device is in the positioning state with the second device, wherein the first merging module, is configured to: if the first device can communicate with the second device by using the first positioning module, the first data is merged with the first positioning signal to generate the first merged data.

In the above proposal, optionally, the first device further comprises:

an alternative module, wherein if the first device cannot communicate with the second device by using the first positioning module, an another communications module of the first device is used to transmit the first data to the second device via the communications module, wherein the another communications module which may be used to transmit the first data and the first positioning module have different functions.

In the above proposal, optionally, the first device further comprises:

a generating module, configured to generate a control command for controlling the second device, wherein the control command is the first data;

a third determining module, configured to determine whether the second device needs to acquire a positioning result of the first device and the second device when the second device is implementing the control command; and a first control module, configured to control the first device to enter into the positioning state with the second device when it is determined that the positioning result of the first device and the second device must be acquired.

In the above proposal, optionally, the first device further comprises:

a second control module, when the first device and the second device are in the positioning state, configured to control the another communications module other than the first positioning module, which may be used to transmit the first data, to be in a closed state, wherein the first positioning module is used to determine the positioning of the first device and the second device, and wherein the another communications module which may be used to transmit the first data and the first positioning module have different functions.

In the above proposal, optionally, the first device further comprises:

a fourth determining module, upon receiving the second positioning signal from the second device, configured to determine whether the second positioning signal comprises the second data;

a first parsing module, if the second positioning signal comprises the second data, configured to parse out the second data from the second positioning signal, and control the second device according to the second data.

In a fourth aspect, an embodiment of the present invention provides a second device comprising:

a receiving module, configured to receive a first positioning signal transmitted by the first device;

a fifth determining module, configured to determine whether the first positioning signal comprises a first data;

a second parsing module, if the first positioning signal comprises the first data, configured to parse out the first data and a first positioning data from the first positioning signal, and control the second device according to the first data and implementing positioning of the first device according to the first positioning data;

a third parsing module, if the first positioning signal does not comprise the first data, configured to parse out the first positioning data from the first positioning signal, and implementing positioning of the first device according to the first positioning data.

In the above proposal, optionally, the fifth determining module comprises:

an extraction unit, configured to extract data of a preset location of the first positioning signal;

a determining unit, configured to determining whether data of the preset location conforms to a preset rule;

a verifying unit, configured to verifying that the first positioning signal comprises the first data if the data of the preset location does not conform to the preset rule, wherein the data of the preset location is the first data.

In the above proposal, optionally, the second device further comprises:

a second merging module, configured to generate the second merged data by merging the second data with a second positioning signal used for positioning when acquiring the second data which will be provided to the first device, wherein the second positioning signal is the positioning signal to be transmitted by the second device to the first device; and a second transmitting module, configured to transmit the second merged data to the first device.

In the above proposal, optionally, the second merging module is configured to:

write the second data to a preset location of the second positioning signal to generate the second merged data, wherein the second merged data comprises at least the second data and a second positioning data.

In the above proposal, optionally, the second device further comprises:

a third control module, if the first positioning signal comprises the first data, configured to control the another communications module other than the second positioning module of the second device which may be used to transmit the first data, to be in a closed state, wherein the another communications module which may be used to transmit the first data and the second positioning module have different functions.

The embodiments of the present invention provides a computer storage medium, wherein the said computer storage medium storing computer-executable instructions for executing the information transmission method of the present invention.

The embodiments of the present invention provide an information transmission method, apparatus, and computer storage medium, wherein in the embodiments of the present invention, when a first device acquires a first data which will be provided to a second device, it is determined whether the first device is in a positioning state with the second device; if the first device is in the positioning state with the second device, a first merged data is generated by merging the first data with a first positioning signal used for positioning, wherein the first positioning signal is the positioning signal to be transmitted by the first device to the second device; and the first merged data is transmitted to the second device. Namely, the tracking and positioning function and the data transmission function of the electronic device may be designed in combination, thereby simplifying the system design of the electronic device, and thereby improving the operating efficiency of the system. Furthermore, because the tracking and positioning function and the data transmission function of the electronic device may be designed in combination, through a control device (e.g., the first device), not only tracking and positioning functions may be achieved, data transmission capabilities can also be achieved, and a user can also realize multiple functions by a remote control device, which simplifies the control of logic for interactions and improves control efficiency, and can reduce the number of data transmissions in order to improve communications efficiency.

DETAILED DESCRIPTION

In the following, embodiments of the present invention will be described with reference to the accompanying drawings, wherein the technical solutions of the embodiments of the present invention will be described clearly and completely.

The present invention hopes to provide an information transmission method, apparatus and computer storage medium, solving the current technical problem for complex system designs of electronic devices having remote control and tracking and positioning functions.

The technical solutions in the embodiments of the present application are to solve the above-mentioned technical problems, the general concepts are as follows:

When a first data is acquired which will be provided to a second device, determining whether the first device is in a positioning state with the second device; if the first device is in the positioning state with the second device, a first merged data is generated by merging the first data with a first positioning signal used for positioning, wherein the first positioning signal is the positioning signal to be transmitted by the first device to the second device; and the first merged data is transmitted to the second device. Namely, the tracking and positioning function and the data transmission function of the electronic device may be designed in combination, thereby simplifying the system design of the electronic device, and thereby improving the operating efficiency of the system. Furthermore, because the tracking and positioning function and the data transmission function of the electronic device may be designed in combination, by using a control device (e.g., the first device), not only tracking and positioning functions may be achieved, data transmission capabilities can also be achieved, and a user can also realize multiple functions by a remote control device, which simplifies the control of logic for interactions and improves control efficiency, and can reduce the number of data transmissions in order to improve communications efficiency.

In order to better understand the above-described technical solutions, the technical solutions of the present invention will be described in detail with reference to the accompanying drawings and specific embodiments. It is to be understood that the embodiments and specific features of embodiments of the present invention are intended to be illustrative of the technical solutions of the present invention and are not to be construed as limitations of the technical solutions of the present invention. When not in conflict, the embodiments and specific features of embodiments of the present invention may be combined with each other.

Figure 1:
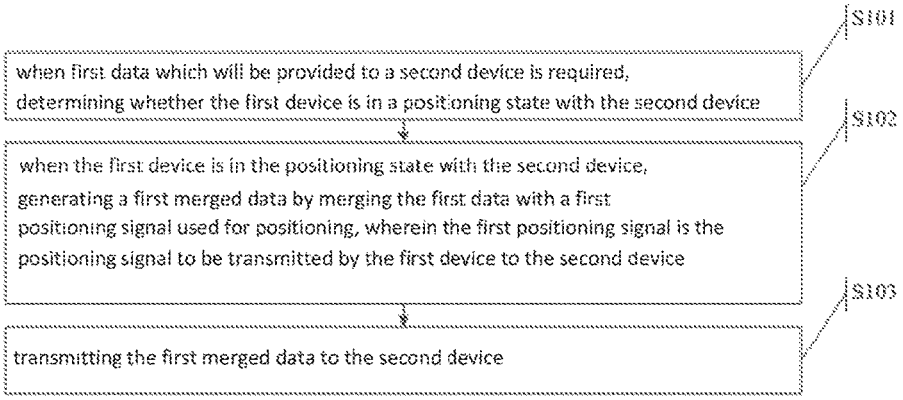
FIG. 1 is a flowchart of an information transmission method according to a first embodiment of the present invention.

In a first aspect, an embodiment of the present invention provides an information transmission method that is used in a first device, referring to FIG. 1, comprising:

Step S101: when a first data which will be provided to a second device is acquired, determining whether the first device is in a positioning state with the second device;

Step S102: when the first device is in the positioning state with the second device, generating a first merged data by merging the first data with a first positioning signal used for positioning, wherein the first positioning signal is the positioning signal to be transmitted by the first device to the second device; and Step S103: transmitting the first merged data to the second device.

For example, the first device comprises, for example, an electronic device having a remote control function such as a mobile phone, a tablet computer, a remote control or the like.

In Step S101, the first data comprises, for example, a control command, other data (such as a document, an image, etc.) transmitted to the second device, and the like, and the embodiments of the present invention are not limited thereto.

After the first device acquires the first data, it can directly detect whether the state of the first positioning module of the first device is opened or closed, and if the first positioning module of the first device is in the opened state, then the first device is in the positioning state with the second device. The first positioning module comprises, for example, a UWB (Ultra-Wideband) positioning module. The UWB positioning module is a type of module which utilizes wireless carrier communications technology and can transmit positioning signals by using nanosecond to picosecond-level non-sinusoidal narrow pulse. Alternatively, after the first device acquires the first data, in addition to detecting whether the first positioning module of the first device is in the opened state, it also may be detected whether the second positioning module of the second device is in the opened state. If it is determined that the positioning modules of the first device and the second device are in an opened state, it is determining that the first device and second device are in a positioning state.

In another embodiment, if the first data is configured as a control command for controlling the second device, after acquiring the first data, it may be determined whether there is a need to acquire the positioning result of the first device and the second device when the second device is implementing the control command, if the positioning result needs to be acquired, the first device can control itself to enter into the positioning state with the second device.

For example, the control commands generated by the first device are, for example: control commands that control the second device to be within a preset distance of the first device. In which case, the second device needs to know the distance value between the first device and the second device, thus, it is instructed that the second device needs to acquire the positioning result (distance value) between the first device and second device when the second device is implementing the control command. Or the control command generated by the first device comprises, for example, controlling the second device to acquire an image when the camera is facing the first device. In which case, the second device needs to determine whether the relative angle value between the second device and the first device is within a preset range, thus, a positioning result (relative angle value) between the first device and the second device needs to be generated, thus, when it is determined that the second device needs to acquire the positioning state between the first device and the second device for implementing the control command (first data), the first device can directly control itself and the second device to enter into the positioning state. For example, the first positioning module of the first device may be controlled to be in an opened state, and it is also possible to generate a control command to control the second positioning module of the second device to be in an opened state, thus controlling the second positioning module of the second device to also be in an opened state.

In a specific embodiment, in Step S102, the first data and the first positioning signal may be directly merged when it is verified that the first device and the second device are in a positioning state, and in another embodiment, the method further comprising: when the first device is in the positioning state with the second device, the method further comprising: determining whether the first device can communicate with the second device by using the first positioning module; generating the first merged data by merging the first data with a first positioning signal used for positioning, comprising: if the first device can communicate with the second device by using the first positioning module, the first data is merged with the first positioning signal to generate the first merged data.

For example, as an example, the first positioning module comprises a UWB positioning module, wherein if it is determined, as in Step S101, that the first device and the second device are in a positioning state (e.g., the UWB positioning module of the first device and the second device are in opened states), it is possible to determine whether the second device is within the effective positioning range of the first device. Because the UWB signal is easily blocked, and the transmission distance is limited, if the second device is located within the effective positioning range of the first device, communications between the first device and the second device may be performed by the first positioning module, wherein a signal may be sent from the first device to the second device through the UWB positioning module to the second device, if signal feedback information of the second device is received by a predetermined time (e.g., 0.01 s, 0.02 s, etc.), then communications between the first device and the second device may be performed by the first positioning module; otherwise, communications between the first device and the second device may not be performed by the first positioning module.

In another embodiment, the method further comprising: if the first device can communicate with the second device by using the first positioning module, an another communications module of the first device which may be used to transmit the first data is used to transmit the first data to the second device via the communications module, wherein the another communications module which may be used to transmit the first data and the first positioning module have different functions.

For example, another communications module which may be used to transmit the first data, of the first device comprises, for example, a Bluetooth module, a WiFi module, etc., wherein if effective communications between the first device and the second device cannot be performed by the first positioning module, it means that the first data cannot be transmitted to the second device through the first positioning module. In this case, in order to ensure that the first data may be reliably transmitted to the second device, the another communications module of the first device may be used, wherein, if the another communications module is in an operating state, the first data is sent to the second device through the corresponding communications module, if the another communications module is not in the operating state, the another communications module may be controlled to be in the operating state. It is also possible to generate a reminder information to prompt the user of the first device to determine whether to control the another communications module to be in an operating state.

In Step S102, the first data is merged with the first positioning signal used for positioning to generate the first merged data, comprising: writing the first data to a preset location of the first positioning signal to generate the first merged data, wherein the first merged data at least comprises the first data and a first positioning data.

For example, the first positioning signal may be set to a preset length (e.g., 10 byte (byte), 20 byte, etc.), wherein a portion of the byte is used to write the first positioning data thereinto and another portion is used to write the first data thereinto. If the first data does not exists, a portion of the byte is used to write the data satisfying the preset rule thereinto, for example, 00000, 11111, etc., so that the first data may be merged with the first positioning signal, for example: the first positioning signal comprises 10 byte, then the first 5 byte may be configured for writing of the first data, and the last 5 byte for writing of the first positioning data. Of course, the first positioning signal may also contain other lengths. The embodiments of the present invention are not described in detail, and are not limited thereto.

In Step S103, upon acquiring the first merged data, the first merged data may be transmitted to the second device through the first positioning module of the first device, wherein after the second device receives the first merged data, the first data and the first positioning data may be parsed out from the first merged data. The second device may control the second device through the first data and perform the positioning process on the first device through the first positioning data. Additionally, the first device may be interchanged with a second device, receive a plurality of first positioning data, and then determine the positioning result of the first device and second device according to the plurality of first positioning data.

In the specific embodiments, the positioning result of the first device and the second device may comprise many types of positioning results, and the positioning results are determined by different methods. The following describes two types of positioning results, and of course, in the specific embodiments, the following two types are not limiting and when not in conflict, the following two types may be combined with each other.

In the specific embodiments, the first positioning signal may be used to determine the positioning result (e.g., distance value, relative angle value, etc.) between the first device and the second device. Following, how the two types of positioning results are generated is introduced, respectively.

A first type, the positioning result comprises the distance value between the first device and the second device, and the distance value between the first device and the second device may be detected by various techniques such as TOF (Time of Flight) techniques, or TDOA (Time Difference of Arrival) techniques, etc. For example, the first device and the second device may measure the distance value by using TWR (Two-way ranging) methods, wherein for each measure event, three communications are required, which specifically comprises the following steps (TWR is an algorithm for TOF):

(1) a first device sends out a first data packet (i.e., a first positioning signal) which, when sent out, the first device records the transmitted timestamp $tt_1$, wherein in the embodiment, the first data packet may be a poll data packet;

(2) a second device waits to receive the first positioning signal sent by the first device, after the second device receives the poll data packet, the timestamp $ta_1$ of the receiving time is recorded, and then, a second data packet is sent and the timestamp $ta_2$ when the second data packet (the second positioning signal) is sent is recorded, wherein in the embodiment, the second data packet may be a response data packet;

(3) the first device waits to receive the positioning signal sent by the second device, after the first device receives the response data packet, the timestamp $tt_2$ of the receiving time is recorded, and then, the timestamp $tt_3$ of the time it takes to send the third data packet (first positioning signal) is calculated and recorded, when the timestamp of the first device reaches $tt_3$ the third data packet is sent, wherein the third data packet comprises the three timestamp information ($tt_1$, $tt_2$, $tt_3$), wherein in the embodiment, the third data packet may be a final data packet.

Figure 2:
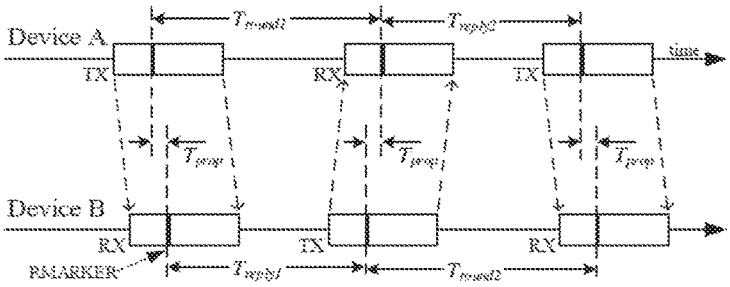
FIG. 2 is a schematic diagram for calculating the distance value between the first device and the second device according to an embodiment of the present invention.

(4) after the second device receives the final data packet, the timestamp $tt_3$ of receipt is recorded. At this time, the second device has already recorded the three timestamps $ta_1$, $ta_2$, $ta_3$, and three final timestamps $tt_1$, $tt_2$, $tt_3$ of the first device may be determined by reading the content of the final data packet;

(5) Since the time of the first device and the second device are not synchronized, it is necessary to calculate the respective time differences of the first device and the second device, as shown in FIG. 2, wherein:

$$T_{round1}=tt_2-tt_1 \quad [1]$$

$$T_{reply1}=ta_2-ta_1 \quad [2]$$

$$T_{round2}=ta_3-ta_2 \quad [3]$$

$$T_{reply2}=tt_3-tt_2 \quad [4]$$

According to the above four time differences, it is possible to calculate the distance value between the first device and the second device, which is calculated as follows:

$$T=(T_{round1}-T_{reply1})/2 \quad [5]$$

$$T=(T_{round2}-T_{reply2})/2 \quad [6]$$

$$D_{IS}=T*V \quad [7]$$

wherein, DIS is the distance value between the first device and the second device, T is the communications time between the first device and the second device, and V is the speed of light.

A second type, the positioning results comprise: a relative angle value between the first device and the second device, wherein the relative angle value between the first device and the second device may be determined by various techniques, such as AOA (Angle of Arrival) techniques, or PDOA (Phase Different of Arrival) techniques, etc., wherein the second device may comprise at least two antennas, wherein when the first device transmits a first positioning signal to the second device (e.g., Poll data packet, Final data packet, etc.), at least two antennas of the second device are in a receiving state so as to be able to receive the first positioning signal. Then, the phase difference of the two antennas of the second device is determined through the first positioning signal, and then the relative angle value between the first device and the second device is determined according to the phase difference, for example, the relative angle value may be calculated by the following equation:

$$P_D=P_1-P_2(\text{in radians}) \quad [8]$$

$$\text{Ang}=(P_D/(2\Pi))*360° \quad [9]$$

wherein $P_1$ is the phase of the first antenna of the second device after the first positioning signal has been received thereby, the unit is radian value, $P_2$ is the phase of the second antenna of the second device after the first positioning signal has been received thereby, the unit is radian value;

$P_D$ is the phase difference of the first and second antennas after the first positioning signal has been received thereby, the unit is radian value;

Ang is the relative angle between the first device and the second device, the units is in degrees.

Corresponding processes according to the positioning results may also be performed after the positioning result between the second device and the first device is determined. Some of the process modes are described as follows, but the specific embodiments are not limiting.

First, if the control command is used to control the second device to be within a preset distance of the first device, after receiving the distance value between the first device and second device, determine whether the distance value is not more than the preset distance value; if the result of the determination is yes, the position of the second device may be kept unchanged, and if the result of the determination is no, the second device may be controlled to move in the direction of the first device.

Second, if the control command is to control the second device to acquire an image when the camera is facing the first device, after receiving the relative angle value between first device and second device, determine whether the relative angle value is within a preset angle range (if within the preset angle range, then it is determined that the second device of the camera is facing the first device), and the second device is controlled to begin image capturing; if not within the preset angle range, the second device is controlled to rotate until the relative angle value is within the preset angle range, and then the second device is controlled to begin image capturing.

In another embodiment, when it is determined according to Step S102, that the first device and the second device are in a positioning state, the method further comprising: controlling an another communications module other than the first positioning module, which may be used to transmit the first data, to be in a closed state, wherein the first positioning module is used to realize the positioning function between the first device and the second device, the another communications module which may be used to transmit the first data and the first positioning module have different functions.

For example, after it is detected that the first device and the second device are in the positioning state, the another communications module may be directly controlled to be in a closed state to save energy consumption of the first device; alternatively, after the first device and the second device are in the positioning state, the first device can determine whether there are other application programs which need to be operating (comprising front-end operations and back-end operations) which correspond to the functions of the communications module; if so, the corresponding communications module is not closed; if not, the corresponding communications module is closed. For example, if the first device and the second device are in the positioning state, the first device sends an image or video to the second device through the WiFi module. In this case, since the image or video occupies a large amount of data, the WiFi module may be kept in the opened state. Alternatively, the idle time of the another communications modules that are in the opened state may be monitored to determine whether the idle time is longer than a preset time (for example: 1 min (min), 2 min, etc.); if it is longer, then the communications module is turned off to save the power of the first device.

In another embodiment, the method further comprising, upon receiving a second positioning signal transmitted by the second device, determining whether the second positioning signal comprises the second data; if the second positioning signal comprises the second data, the second data is parsed out from the second positioning signal, and the second device is controlled according to the second data.

The second signal is, for example, a control command transmitted by the second device to the first device, or other information (e.g., status information of the second device), etc. The second device writing the second data in the second positioning signal is similar to the manner in which the first device writes the first data into the first positioning signal, thus, it will not be described here again.

The second device can analyze its own status information, and then when its own status information conforms to a preset condition, send the second positioning signal which includes the status information to the first device. The first device extracts the status information from the second positioning signal, and performs related processing according to the status information for example, generate alarm information according to the status information, output the status information, or the like. Alternatively, the second device generates alarm information when its own status information conforms to the preset condition, then, send the second positioning signal which includes the alarm information to the first device. The first device extracts the alarm information from the second positioning signal and outputs the alarm information. The status information of the second device conforms to the preset condition comprising, for example, exist crash between the second device and other devices, the speed of the second device is greater than a preset speed value (e.g., 10 km/h (km/h), 20 km/h, etc.), wherein after the first device receives the alarm information (receiving the alarm information of the second device or generating the alarm information according to the status information of the second device), the alarm information may be output, for example, by flashing a light emitting diode (LED, Light Emitting Diode) lamp, or vibrating a motor vibration etc., and the alarm information may be feed back to the operator of the first device.

Figure 3:
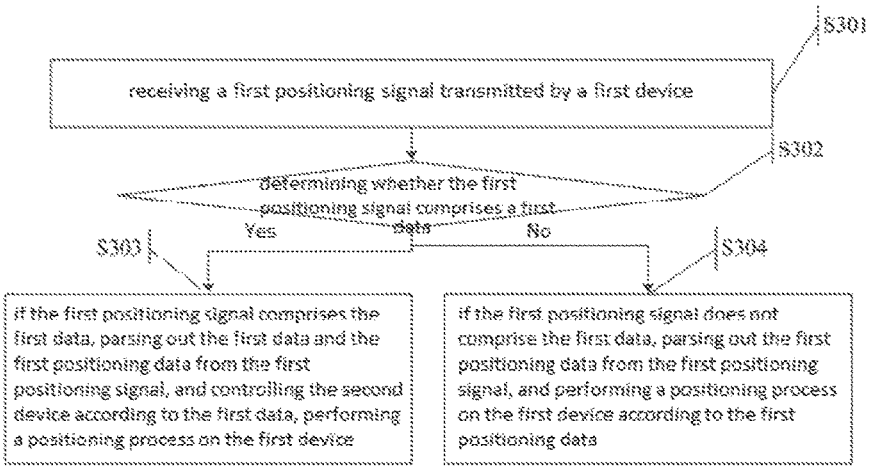
FIG. 3 is a flowchart of an information transmission method according to a second embodiment of the present invention.

In a second aspect, an embodiment of the present invention provides, according to a same inventive concept, an information transmission method that is used in a second device, referring to FIG. 3, comprising:

Step S301: receiving a first positioning signal transmitted by a first device;

Step S302: determining whether the first positioning signal comprises the first data;

Step S303: if the first positioning signal comprises the first data, parsing out the first data and the first positioning data from the first positioning signal, and controlling the second device according to the first data, performing a positioning process on the first device according to the first positioning data, Step S304: if the first positioning signal does not comprise the first data, parsing out the first positioning data from the first positioning signal, and performing a positioning process on the first device according to the first positioning data.

For example, the second device comprises, for example, mobile phones, tablet computers, notebook computers, balance vehicles, unmanned aerial vehicles, or the like.

In Step S301, the first positioning signal received by the second device may include two cases, for example: ① comprising only the first positioning data; ② comprising the first positioning data+the first data (the first positioning data and the first data are merged as the first merged data which is described in a first aspect of the embodiment of the present invention).

In Step S302, first, the data of the preset location of the first positioning signal is extracted; whether the data of the preset location conforms to a preset rule is determined; if the data of the preset location does not conform with the preset rule, it is determined that the first positioning signal comprises the first data, wherein the data of the preset location is the first data.

For example, the preset position in the first positioning signal may be written to conform to preset data of a preset rule, for example, 00000, 11111, etc. If the first positioning signal comprises the first data, the preset data is overwritten by the first data; after receiving the data of the preset location, if it is determined that it has not been overwritten by the first data, the data of the preset location conforms to a preset rule, such that it is determined that the first positioning signal did not comprise the first data; after receiving the data of the preset location, if it is determined that it has been overwritten, the data will not conform with the preset rule, such that the first positioning signal does comprise the first data.

If the first positioning signal comprises the first data, the data of the preset location in the first positioning signal is directly extracted as the first data.

In another embodiment, the method further comprising: if the positioning signal comprises the first data, the another communication module other than the second positioning module of the second device which may be used to transmit the first data, may be controlled to be in a closed state, wherein the another communications module which may be used to transmit the first data and the first positioning module have different functions.

For example, if the first positioning signal comprises the first data, then, the first data may be transmitted via the second positioning module. In which case, the another communications modules may be controlled to be in a closed state to save energy consumption of the electronic device. Likewise, the second device may directly control the another communications modules to be in a closed state to save energy consumption of the second device. Alternatively, the second device can determine whether there are other application programs which need to be operating (comprising front-end operations and back-end operations) which correspond to the functions of the communications module; if so, the corresponding communications module is not closed; if not, the corresponding communications module is closed. For example, if the first device and the second device are in the positioning state, the first device sends an image or video to the second device through the WiFi module. In this case, since the image or video occupies a large amount of data, the WiFi module may be kept in the opened state. Alternatively, the idle time of the another communications modules that are in the opened state may be monitored to determine whether the idle time is longer than a preset time (for example: 1 min, 2 min, etc.); if it is longer, then the communications module is turned off to save the power of the second device.

In another embodiment, the method further comprising:

when acquiring the second data which will be provided to the first device, generating a second merged data by merging the second data with a second positioning signal used for positioning; wherein the second positioning signal is the positioning signal to be transmitted by the second device to the first device; and transmitting the second merged data to the first device.

The manner in which the second data is merged with the second positioning signal is similar to that in which the first data is merged with the first positioning signal, and therefore, the description will not be repeated here. The data for the second data and the timing for the second device to transmit the second data are not described here since they have been previously described.

Based on the embodiments, it is also possible to reduce the number of data transmissions and improve communications efficiency.

In another embodiment, a second merged data is generated by merging the second data with a second positioning signal used for positioning, comprising: writing the second data to a preset location of the second positioning signal to generate the second merged data, wherein the second merged data at least comprises the second data and a second positioning data. The manner in which the second data is written into the preset location of the second positioning signal is similar to the manner of writing the first data into the preset location of the first positioning signal, thus, the description will not be repeated here.

In order to enable those skilled in the art to further understand the information transmission method described in the embodiments of the present invention, as examples, the first device will be described as comprising a remote control and the second device will be described as comprising a robot.

The remote control comprises the following structure: a UWB antenna, a number of buttons, a rocker, a processor and a gyroscope, etc. Additionally, the remote control comprises a number of LED lights and vibration motors thereon for status information feedback. Different command signals are sent with different keys. The rocker may be used for remote control and adjusting the robot. The gyroscope may have real-time detection of the status of the remote control.

The robot comprises the following structure: two UWB antennas and a processor.

Figure 4:
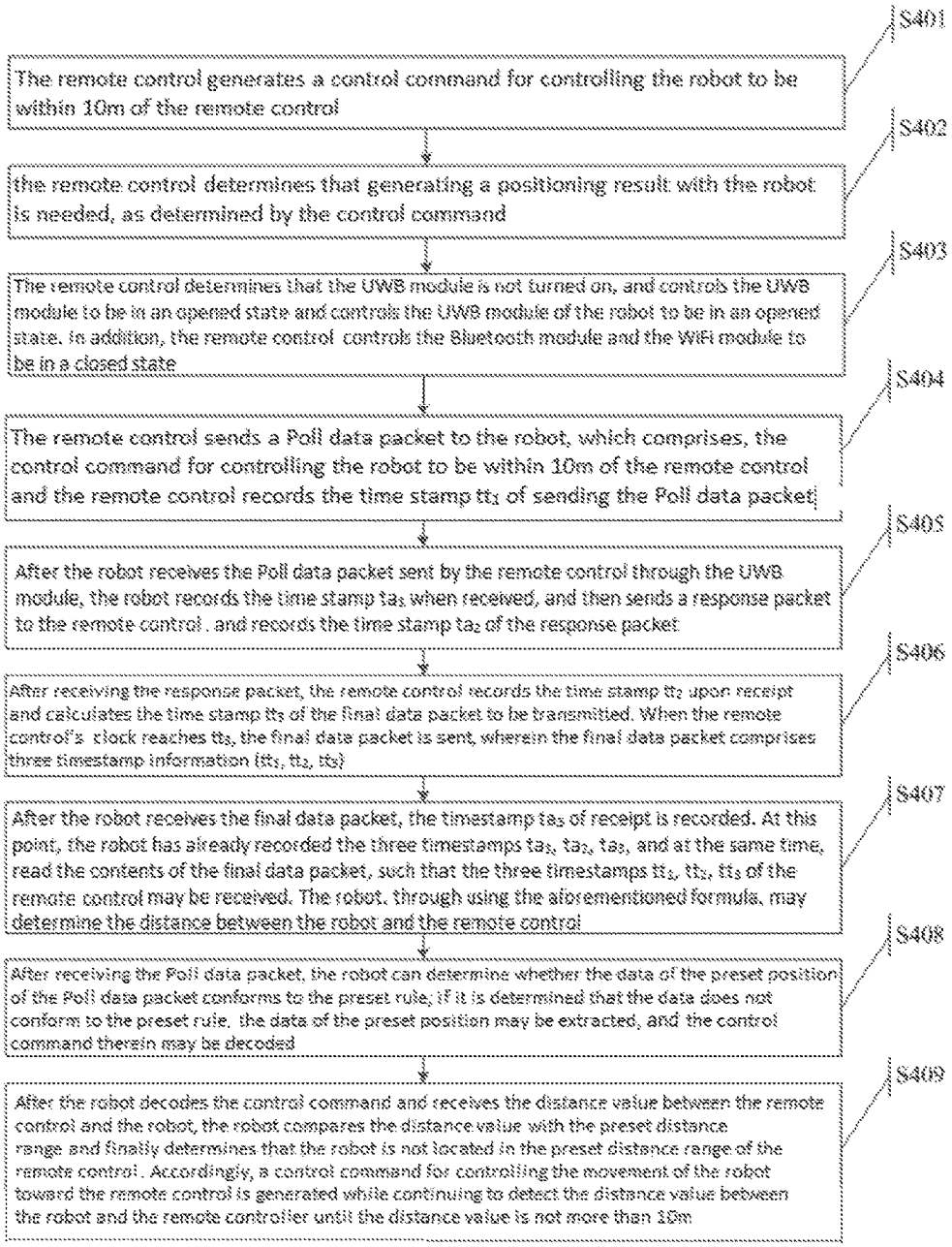
FIG. 4 is a flowchart of an information transmission method according to interaction between a remote control and a robot according to an embodiment of the present invention.

Referring to FIG. 4, the information transmission method comprises a remote control and a robot, the method comprising:

Step S401: The remote control generates a control command for controlling the robot to be within 10 m of the remote control (10 m is only a set value, which may be set differently of actual needs).

Step S402: the remote control determines that generating a positioning result with the robot is needed, as determined by the control command;

Step S403: The remote control determines that the UWB module is not turned on, and controls the UWB module to be in an opened state and controls the UWB module of the robot to be in an opened state. In addition, the remote control controls the Bluetooth module and the WiFi module to be in a closed state;

Step S404: The remote control sends a first poll data packet to the robot, which comprises, the control command for controlling the robot to be within 10 m of the remote control, and the remote control records the time stamp $tt_1$ of sending the Poll data packet;

Step S405: After the robot receives the Poll data packet sent by the remote control through the UWB module, the robot records the time stamp $ta_1$ when received, and then sends a response packet to the remote control, and records the time stamp $ta_2$ of the response packet;

Step S406: After receiving the response packet, the remote control records the time stamp $tt_2$ upon receipt and calculates the time stamp $tt_3$ of the final data packet to be transmitted. When the remote control's clock reaches $tt_3$, the final data packet is sent, wherein the final data packet comprises three timestamp information ($tt_1$, $tt_2$, $tt_3$);

Step S407: After the robot receives the final data packet, the timestamp $ta_3$ of receipt is recorded. At this point, the robot has already recorded the three timestamps $ta_1$, $ta_2$, $ta_3$, and at the same time, read the contents of the final data packet, such that the three timestamps $tt_1$, $tt_2$, $tt_3$ of the controller may be received. The robot, through using the aforementioned formula [7], may determine the distance between the robot and the remote control, for example, 13 m (of course, it can also be other values, such as: 8 m, 10 m, etc.);

Step S408: After receiving the Poll data packet, the robot can determine whether the data of the preset location of the Poll data packet conforms to the preset rule; if it is determined that the data does not conform to the preset rule, the data of the preset location may be extracted, and the control command therein may be decoded;

Step S409: After the robot decodes the control command and receives the distance value between the remote control and the robot, the robot compares the distance value (13 m) with the preset distance range (10 m) and finally determines that the robot is not located in the preset distance range of the remote control. Accordingly, a control command for controlling the movement of the robot toward the remote control is generated while continuing to detect the distance value between the robot and the remote control until the distance value is not more than 10 m.

Figure 5:
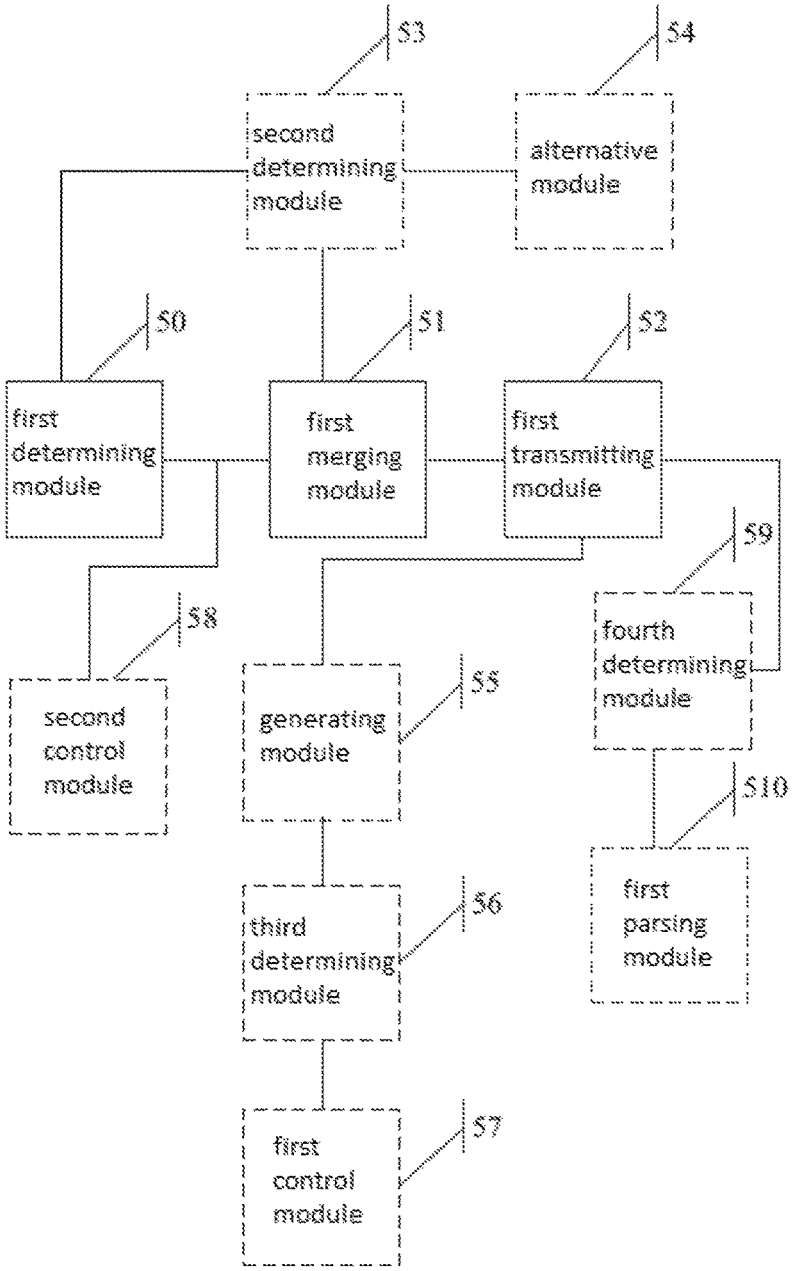
FIG. 5 is a block diagram of a first apparatus according to a third embodiment of the present invention.

From a third-party manufacturing aspect, according to a same inventive concept, an embodiment of the present invention provides a first apparatus, referring to FIG. 5, comprising:

a first determining module 50, configured to determine whether the first device is in a positioning state with the second device;

a first merging module 51, configured to generate a first merged data by merging the first data with a first positioning signal used for positioning when the first device is in the positioning state with the second device, wherein the first positioning signal is the positioning signal to be transmitted by the first device to the second device;

a first transmitting module 52, configured to transmit the first merged data to the second device.

Optionally, the first merging module 51, is configured to:

write the first data to a preset location of the first positioning signal to generate the first merged data, wherein the first merged data at least comprises the first data and a first positioning data.

Optionally, the first device further comprises:

a second determining module 53, configured to determine whether communications between the first device and the second device may be performed by a first positioning module when the first device and the second device are in a positioning state, wherein the first merging module 51, is configured to: if communications between the first device and the second device may be performed by the first positioning module, the first data is merged with the first positioning signal to generate the first merged data.

Optionally, the first device further comprises:

an alternative module 54, wherein if communications between the first device and the second device cannot be performed by the first positioning module, an another communications module of the first device is used to transmit the first data to the second device via the communications module, wherein the another communications module which may be used to transmit the first data and the first positioning module have different functions.

Optionally, the first device further comprises:

a generating module 55, configured to generate a control command for controlling the second device, wherein the control command is the first data;

a third determining module 56, configured to determine whether the second device needs to acquire the positioning result of the first device and the second device when the second device is implementing the control command; and a first control module 57, configured to control the first device and the second device to enter into the positioning state when it is determined that the positioning result must be generated.

Optionally, the first device further comprises:

a second control module 58, configured to control the another communications module other than the first positioning module, which may be used to transmit the first data, to be in a closed state, wherein the first positioning module is used to determine the positioning of the first device and the second device, and wherein the another communications module which may be used to transmit the first data and the first positioning module have different functions.

Optionally, the first device further comprises:

a fourth determining module 59, configured to determine whether the second positioning signal comprises the second data upon receiving the second positioning signal from the second device;

a first parsing module 510, configured to parse out the second data from the second positioning signal, if the second positioning signal comprises the second data, and controlling the second device according to the second data.

In an embodiment, the first determining module 50, the first merging module 51, the first transmitting module 52, the second determining module 53, the alternative module 54, the generating module 55, the third determining module 56, the first control module 57, the second control module 58, the fourth determining module 59, and the first parsing module 510, may be implemented by a CPU (central processing unit) of the first device, MCU (microcontroller unit), a DSP (digital signal processor), a PLC (programmable logic controller), or the like. In an embodiment, the first transmitting module 52 may also be implemented by a communications device of the first device.

The embodiment of the first device not only achieves tracking and positioning functions, data transmission capabilities can also be achieved, and a user can also realize multiple functions by a first device, which simplifies the control of logic for interactions and improves control efficiency, and can reduce the number of data transmissions in order to improve communications efficiency.

Figure 6:
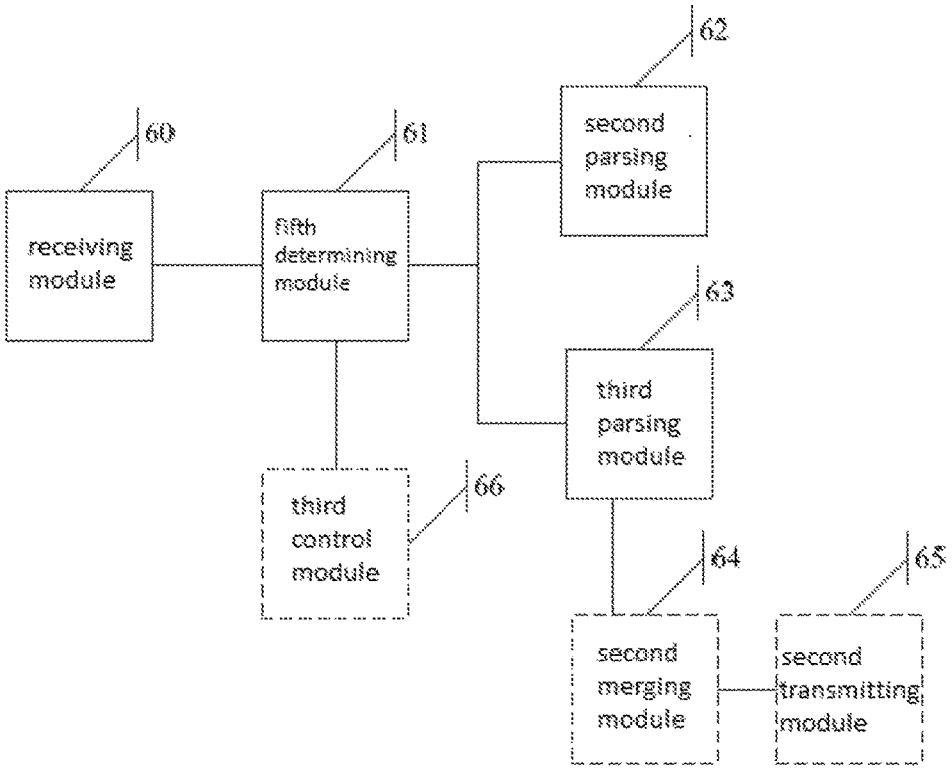
FIG. 6 is a block diagram of a second device according to a fourth embodiment of the present invention.

In a fourth aspect, of the same inventive concept, an embodiment of the present invention provides a second device, referring to FIG. 6, comprising:

a receiving module 60, configured to receive a first positioning signal transmitted by the first device, a fifth determining module 61, configured to determine whether the first positioning signal comprises a first data, a second parsing module 62, configured to parse out the first data and the first positioning data from the first positioning signal, and control the second device according to the first data and implement positioning of the first device according to the first positioning data, when it is determined that the first positioning signal comprises the first data;

a third parsing module 63, configured to parse out the first positioning data from the first positioning signal if the first positioning signal does not comprise the first data and implement positioning of the first device according to the first positioning data, when it is determined that the first positioning signal does not comprise the first data.

Optionally, the fifth decision module 61 comprises:

an extraction unit, configured to extract data of a preset location of the first positioning signal;

a determining unit, configured to determine whether data of the preset location conforms to a preset rule;

a verifying unit, configured to determine that the first positioning signal comprises the first data if the preset location does not conform to a preset rule, wherein the data of the preset location is the first data.

Optionally, the second device further comprises:

a second merging module 64, configured to generate a second merged data by merging the second data with a second positioning signal used for positioning when the second data which will be provided to the first device is acquired; wherein the second positioning signal is the positioning signal to be transmitted by the second device to the first device; and a second transmitting module 65, configured to transmit the second merged data to the first device.

Optionally, the second merging module 64, is configured to:

write the second data to a preset location of the second positioning signal to generate the first merged data, wherein the second merged data at least comprises the second data and a second positioning data.

Optionally, the second device further comprises:

a third control module 66 which is configured to, if the first positioning signal comprises the first data, control the another communications module other than the second positioning module of the second device which may be used to transmit the first data, to be in a closed state, wherein the another communications module which may be used to transmit the first data and the second positioning module have different functions.

In an embodiment, the receiving module 60, the fifth decision module 61, the second parsing module 62, the third parsing module 63, the second merging module 64, the second transmitting module 65, and the third control module 66, may be implemented by a CPU (central processing unit) of the second device, MCU (microcontroller unit), a DSP (digital signal processor), a PLC (programmable logic controller), or the like. In an embodiment, the receiving module 60 and the second transmitting module 65 may also be implemented by a communications device of the second device.

The embodiment of the second device saves power consumption, and can reduce the number of data transmissions in order to improve communications efficiency.

The embodiments of the present invention also comprise a computer storage medium, the computer storage medium storing computer-executable instructions for executing the information transmission method of the embodiment of the present invention.

One or more embodiments of the present invention have at least the following beneficial effects:

Because in the embodiment of the present invention, when first data which will be provides to a second device is acquired, it is determined whether the first device is in a positioning state with the second device; when the first device is in the positioning state with the second device, a first merged data is generated by merging the first data with a first positioning signal used for positioning, wherein the first positioning signal is the positioning signal to be transmitted by the first device to the second device; and the first merged data is transmitted to the second device. Namely, the tracking and positioning function and the data transmission function of the electronic device may be designed in combination, thereby simplifying the system design of the electronic device, and thereby improving the operating efficiency of the system. Furthermore, because the tracking and positioning function and the data transmission function of the electronic device may be designed in combination, through a control device (e.g., the first device), not only tracking and positioning functions may be achieved, data transmission capabilities can also be achieved, and a user can also realize multiple functions by a remote control device to simplify control of the interacting logic and improve control efficiency, and can reduce the number of data transmissions, in order to improve the communications efficiency.

It will be appreciated by those skilled in the art, that the embodiments of the present invention may be provided as a method, system, or in a computer program in a product. Accordingly, the present invention may be implemented in an embodiment incorporating hardware, software, or an embodiment incorporating software and hardware. Moreover, the present invention may be provided as a computer program product using one or more computer-readable storage mediums (including, but not limited to, disc memories, CD-ROMs optical memories, etc.), having computer program code therein.

The present invention is described with reference to flowcharts and/or block diagrams of a method, apparatus (system), and computer program product of embodiments of the present invention. It is to be understood that each flowchart and/or block diagram of the flowcharts and/or block diagrams, as well as combinations of a flowchart and/or block diagram of the flowcharts and/or block diagrams, may be implemented by computer program commands. These computer program commands may be provided to a general purpose computer, a special purpose computer, an embedded process alternatively, or other programmable data processing device to produce a machine, such that the commands are generated by using a processor of a computer or other programmable data processing device for implementing the specific functions of the apparatus of the flowchart or flowcharts and/or block diagram or block diagrams.

These computer program commands may also be stored in a computer readable memory capable of directing a computer or other programmable data processing devices to operate in a particular manner, such that the commands stored in the computer readable memory are implemented, including in a manufacturing product of a command apparatus, wherein the command apparatus implements a specific function of the flowchart or flowcharts and/or block diagram or block diagrams.

These computer program commands may also be loaded onto a computer or other programmable data processing device, such that a series of process steps are implemented on the computer or other programmable device, wherein the implemented commands on the computer or other programmable data device provide the steps for implementing the specific functions of the flowchart or flowcharts and/or block diagram or block diagrams.

Although preferred embodiments of the present invention have been described, those skilled in the art, upon learning of the basic inventive concept, may make other alterations and modifications to these embodiments. Therefore, it is intended that the appended claims be interpreted as including the preferred embodiments and all alterations and modifications that fall within the scope of the present invention.

It will be apparent to those skilled in the art that various alterations and modifications may be made to the present invention without departing from the spirit and scope of the present invention. Thus, such modifications and alterations, insofar as they fall within the scope of the appended claims and their equivalents, are understood as being included in the present invention.

INDUSTRIAL APPLICABILITY

In the embodiments of the present invention, when a second device receives a first data, it is determined whether the first device and the second device are in a positioning state; if the first device and the second device are in a positioning state, a first merged data is generated by merging the first data with a first positioning signal used for positioning, wherein the first positioning signal is the positioning signal to be transmitted by the first device to the second device; and the first merged data is transmitted to the second device. Accordingly, the tracking and positioning function and the data transmission function of the electronic device may be designed in combination, thereby simplifying the system design of the electronic device, and thereby improving the operating efficiency of the system. Furthermore, because the tracking and positioning function and the data transmission function of the electronic device may be designed in combination, by using a control device (e.g., the first device), not only tracking and positioning functions may be achieved, data transmission capabilities can also be achieved, and a user can also realize multiple functions by a remote control device, which simplifies the control of logic for interactions and improves control efficiency, and can reduce the number of data transmissions in order to improve communications efficiency.

What is claimed is:

1. An information transmission method that is used in a first device, the method comprising: when first data, which will be provided to a second device, is acquired, determining whether the first device is in a positioning state with the second device; when the first device is in the positioning state with the second device, generating first merged data by merging the first data with a first positioning signal used for positioning, wherein the first positioning signal is configured to initiate a sequence between the first device and the second device to determine a relative position of the first device and the second device, wherein determining the relative position of the first device and the second device comprises: recording a time that the first merged data is transmitted to the second device to create a first time record; recording a time that a second positioning signal is received by the first device from the second device to create a second time record; and transmitting the first time record and the second time record from the first device to the second device via a third positioning signal; and transmitting the first merged data to the second device.

2. The method of claim 1, wherein generating the first merged data by merging the first data with the first positioning signal used for positioning comprises: writing the first data to a preset location of the first positioning signal to generate the first merged data, wherein the first merged data at least comprises the first data and first positioning data.

3. The method of claim 1, wherein: when the first device is in the positioning state with the second device, the method further comprises determining whether the first device can communicate with the second device using a first positioning module; and generating the first merged data by merging the first data with the first positioning signal used for positioning, comprises: if the first device can communicate with the second device using the first positioning module, the first data is merged with the first positioning signal to generate the first merged data.

4. The method of claim 3, further comprising: if the first device cannot communicate with the second device using the first positioning module, using another communications module of the first device to transmit the first data to the second device, wherein the another communications module and the first positioning module have different functions.

5. The method of claim 1, further comprising: generating a control command for controlling the second device, wherein the control command is the first data; determining whether there is a need to acquire a positioning result of the first device and the second device when the second device is implementing the control command; and when it is determined that the positioning result must be acquired, controlling the first device to enter into the positioning state with the second device.

6. The method of claim 1, further comprising: upon receiving the second positioning signal transmitted from the second device, determining whether the second positioning signal comprises second data; and if the second positioning signal comprises the second data, parsing out the second data from the second positioning signal and controlling the second device according to the second data.

7. An information transmission method that is used in a second device, the method comprising: receiving a first positioning signal transmitted by a first device, wherein the first positioning signal is configured to initiate a sequence between the first device and the second device to determine a relative position of the first device and the second device, wherein determining the relative position of the first device and the second device comprises: recording a time that the first positioning signal is received by the second device to create a first time record; sending a second positioning signal to first device; and recording a time when the second positioning signal is sent to the first device to create a second time record; determining whether the first positioning signal comprises first data; if the first positioning signal comprises the first data: parsing out the first data and first positioning data from the first positioning signal; controlling the second device according to the first data; and implementing positioning of the first device according to the first positioning data; and if the first positioning signal does not comprise the first data, parsing out the first positioning data from the first positioning signal; and implementing positioning of the first device according to the first positioning data.

8. The method of claim 7, further comprising: when receiving second data which will be provided to the first device, generating second merged data by merging the second data with the second positioning signal used for positioning; and transmitting the second merged data to the first device.

9. The method of claim 8, wherein generating the second merged data by merging the second data and the second positioning signal used for positioning comprises: generating the second merged data by writing the second data into a preset location of the second positioning signal, wherein the second merged data at least comprises the second data and a second positioning data.

10. A non-transitory computer storage medium storing computer-executable instructions for executing the information transmission method of claim 1.

11. A non-transitory computer storage medium storing computer-executable instructions for executing the information transmission method of claim 7.

12. The method of claim 7, wherein: the first data comprises a control command specifying a maximum distance threshold between the first device and the second device, and the method further comprises, upon determining the relative position of the first device and the second device, controlling the second device to move in a direction toward the first device when a distance between the first device and the second device exceeds the maximum distance threshold based upon the relative position of the first device and the second device.

13. The method of claim 7, wherein: the first data comprises a control command specifying an action to perform when the second device is rotated to a specified angle relative to the first device, and the method further comprises, upon determining the relative position of the first device and the second device, controlling the second device to perform the action when the second device is rotated to the specified angle relative to the first device based upon the relative position of the first device and the second device.

14. The method of claim 7, wherein: receiving the first positioning signal comprises: receiving the first positioning signal at a first antenna of the second device; and receiving the first positioning signal at a second antenna of the second device, and the method further comprises: determining a phase of the first antenna after the first positioning signal is received to generate a first phase measurement determining a phase of the second antenna after the first positioning signal is received to generate a second phase measurement; and determining a phase difference of the first antenna and the second antenna using the first phase measurement and the second phase measurement.

15. An information transmission method that is used in a second device, the method comprising: receiving a first positioning signal transmitted by a first device, wherein the first positioning signal is configured to initiate a sequence between the first device and the second device to determine a relative position of the first device and the second device; determining whether the first positioning signal comprises first data, wherein the first data comprises a control command specifying a maximum distance threshold between the first device and the second device; if the first positioning signal comprises the first data: parsing out the first data and first positioning data from the first positioning signal; controlling the second device according to the first data comprising, upon determining the relative position of the first device and the second device, controlling the second device to move in a direction toward the first device when a distance between the first device and the second device exceeds the maximum distance threshold based upon the relative position of the first device and the second device; and implementing positioning of the first device according to the first positioning data; and if the first positioning signal does not comprise the first data, parsing out the first positioning data from the first positioning signal; and implementing positioning of the first device according to the first positioning data.

16. The method of claim 15, further comprising: when receiving second data which will be provided to the first device, generating second merged data by merging the second data with a second positioning signal used for positioning, wherein the second positioning signal is a positioning signal to be transmitted by the second device to the first device; and transmitting the second merged data to the first device.

17. The method of claim 16, wherein generating the second merged data by merging the second data and the second positioning signal used for positioning comprises: generating the second merged data by writing the second data into a preset location of the second positioning signal, wherein the second merged data at least comprises the second data and a second positioning data.

18. A non-transitory computer storage medium storing computer-executable instructions for executing the information transmission method of claim 15.

19. An information transmission method that is used in a second device, the method comprising; receiving a first positioning signal transmitted by a first device, wherein the first positioning signal is configured to initiate a sequence between the first device and the second device to determine a relative position of the first device and the second device; determining whether the first positioning signal comprises first data, wherein the first data comprises a control command specifying an action to perform when the second device is rotated to a specified angle relative to the first device; if the first positioning signal comprises the first data: parsing out the first data and first positioning data from the first positioning signal; controlling the second device according to the first data comprising, upon determining the relative position of the first device and the second device, controlling the second device to perform the action when the second device is rotated to the specified angle relative to the first device based upon the relative position of the first device and the second device; and implementing positioning of the first device according to the first positioning data; and if the first positioning signal does not comprise the first data, parsing out the first positioning data from the first positioning signal; and implementing positioning of the first device according to the first positioning data.

20. A non-transitory computer storage medium storing computer-executable instructions for executing the information transmission method of claim 19.

* * * * *